US011029715B1

(12) United States Patent
Ware et al.

(10) Patent No.: US 11,029,715 B1
(45) Date of Patent: Jun. 8, 2021

(54) REFERENCE-FOLLOWING VOLTAGE CONVERTER

(71) Applicant: Rambus Inc., Sunnyvale, CA (US)

(72) Inventors: Frederick A. Ware, Los Altos Hills, CA (US); John Eric Linstadt, Palo Alto, CA (US)

(73) Assignee: Rambus Inc., San Jose, CA (US)

( * ) Notice: Subject to any disclaimer, the term of this patent is extended or adjusted under 35 U.S.C. 154(b) by 0 days.

(21) Appl. No.: 16/853,644

(22) Filed: Apr. 20, 2020

Related U.S. Application Data

(63) Continuation of application No. 16/436,702, filed on Jun. 10, 2019, now Pat. No. 10,649,478, which is a continuation of application No. 15/221,854, filed on Jul. 28, 2016, now Pat. No. 10,345,836.

(60) Provisional application No. 62/208,244, filed on Aug. 21, 2015.

(51) Int. Cl.
*G05F 1/567* (2006.01)
*G05F 1/56* (2006.01)

(52) U.S. Cl.
CPC ..... *G05F 1/567* (2013.01); *G05F 1/56* (2013.01)

(58) Field of Classification Search
CPC ..... G05F 1/567; G05F 1/56
USPC ..... 327/541
See application file for complete search history.

(56) References Cited

U.S. PATENT DOCUMENTS

| | | | | |
|---|---|---|---|---|
| 3,807,188 | A | 4/1974 | Lagodmos | |
| 3,902,000 | A | 8/1975 | Forsyth et al. | |
| 4,606,201 | A | 8/1986 | Longsworth | |
| 8,710,862 | B2 | 4/2014 | Ferolito et al. | |
| 9,000,295 | B1 | 4/2015 | Graber et al. | |
| 2003/0011426 | A1 | 1/2003 | Casper | |
| 2004/0008054 | A1 | 1/2004 | Lesea et al. | |
| 2006/0001176 | A1* | 1/2006 | Fukaishi | H01L 25/0657 |
| 2009/0122904 | A1 | 5/2009 | Jang et al. | |
| 2012/0103659 | A1 | 5/2012 | Sutherland | |
| 2013/0010546 | A1 | 1/2013 | Wang et al. | |
| 2013/0229164 | A1* | 9/2013 | Al-Dahle | G05F 1/613 323/299 |
| 2014/0281075 | A1 | 9/2014 | Hollis | |

* cited by examiner

*Primary Examiner* — Tomi Skibinski
(74) *Attorney, Agent, or Firm* — Charles Shemwell

(57) ABSTRACT

A voltage converter includes first and second inputs to receive a supply voltage and a reference voltage, respectively, from a power supply component, the supply voltage being higher than the reference voltage by a scaling factor of at least five. The voltage converter iteratively charges an internal filter capacitor to produce a converted voltage that follows the reference voltage by switchably coupling the first input to the filter capacitor while the converted voltage is less than the reference voltage to raise the converted voltage, and by switchably decoupling the first input from the filter capacitor while the converted voltage exceeds the reference voltage to enable the converted voltage to decay.

20 Claims, 5 Drawing Sheets

*Cold-sourced transmission*

*Hot-sourced transmission*

*Thermal overhead (e.g., ~ 148mV) shared between two or more bits per symbol per link*

| C1 | C2 | C3 | $A_{i+1}$ | $A_i$ |
|---|---|---|---|---|
| 1 | 1 | 1 | 1 | 1 |
| 0 | 1 | 1 | 1 | 0 |
| 0 | 0 | 1 | 0 | 1 |
| 0 | 0 | 0 | 0 | 0 |

FIG. 4 voltage/current scaled power delivery
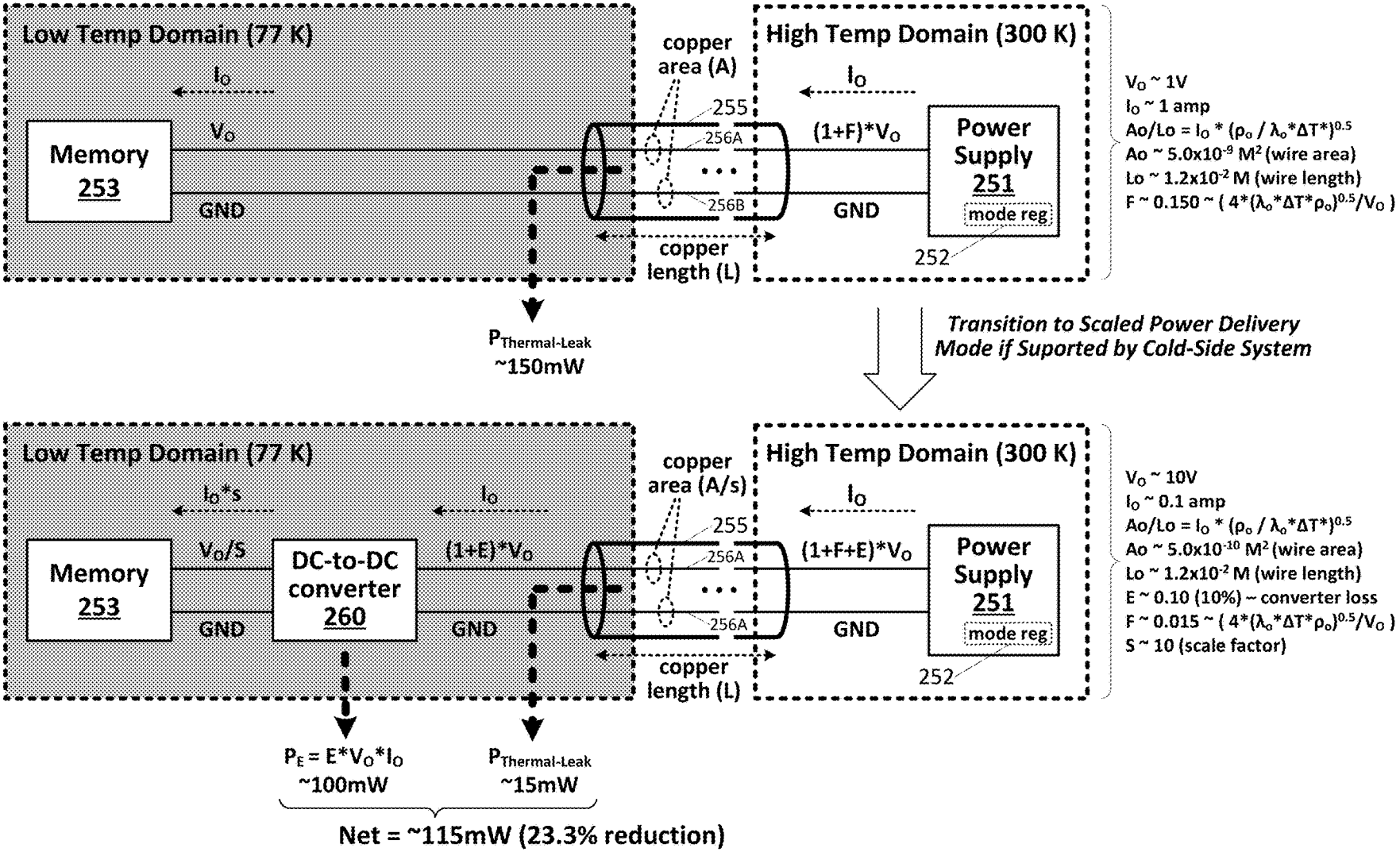

REFERENCE-FOLLOWING VOLTAGE CONVERTER

CROSS-REFERENCE TO RELATED APPLICATIONS

This application is a continuation of U.S. application Ser. No. 16/436,702 filed Jun. 10, 2019 (issued as U.S. Pat. No. 10,649,478), which is a continuation of U.S. application Ser. No. 15/221,854 filed Jul. 28, 2016 (issued as U.S. Pat. No. 10,345,836), which claims priority to U.S. Provisional Application No. 62/208,244 filed Aug. 21, 2015. Each of the above-identified applications is hereby incorporated by reference.

TECHNICAL FIELD

The present invention relates to conductive high-speed signaling between integrated-circuit devices.

BACKGROUND

Radio-frequency signals transmitted along a conductive chip-to-chip transmission path tend to reflect from impedance discontinuities along the path length, traveling back down the transmission path toward the signal source and thus distorting subsequently transmitted signals.

High-impedance signal receivers constitute primary sources of impedance discontinuity in modern chip-to-chip signaling systems and are typically compensated by an impedance-matching termination load (i.e., resistance or impedance that matches the characteristic impedance of the transmission path) coupled to the transmission path in close proximity to the signal receiver—for example, on the same integrated circuit (IC) die or in the same IC package. Unfortunately, this receiver-site termination arrangement results in termination power dissipation that, while negligible in many signaling applications, imposes considerable cooling overhead in emerging cryogenic applications.

BRIEF DESCRIPTION OF THE DRAWINGS

The present invention is illustrated by way of example, and not by way of limitation, in the figures of the accompanying drawings and in which like reference numerals refer to similar elements and in which:

FIG. 4 contrasts exemplary non-scaled and scaled power delivery modes that may be enabled within a power supply for the various cross-temperature signaling system embodiments described herein.

DETAILED DESCRIPTION

A signaling system and integrated circuit components thereof that implement signal termination exclusively at one end of a conductive bidirectional signaling path coupled between the integrated circuit components, and thus asymmetric signal path termination, are disclosed herein in various embodiments. In a number of embodiments, for example, integrated circuit (IC) devices disposed in respective cryogenic and ambient temperature domains ("low temperature" and "high-temperature" integrated circuit components and domains) are coupled by one or more wired, asymmetrically-terminated signaling links, and include respective transceiver circuits to drive and receive high-speed signals via the signal links. By locating termination loads exclusively within the high-temperature IC component or otherwise within the high-temperature domain, signal integrity is maintained without undesired termination power dissipation in the cryogenic domain, thus enabling high-speed chip-to-chip signaling between the two temperature domains with negligible cryogenic cooling penalty.

In the various asymmetrically terminated embodiments and others described below, multi-level signaling may be employed to reduce thermal overhead losses resulting from thermally-conductive electrical conductors extending between the ambient and cryogenic temperature domains. Also, in a number of embodiments, scaled power supply voltages and currents are delivered to the cryogenic domain to reduce resistive and thermal-conduction power loss, with the scaled voltage/current arriving within the low-temperature domain being converted (or restored) to desired levels in-situ for application to local signaling transceivers and other circuitry.

Figures 1A, 1B, 1C:
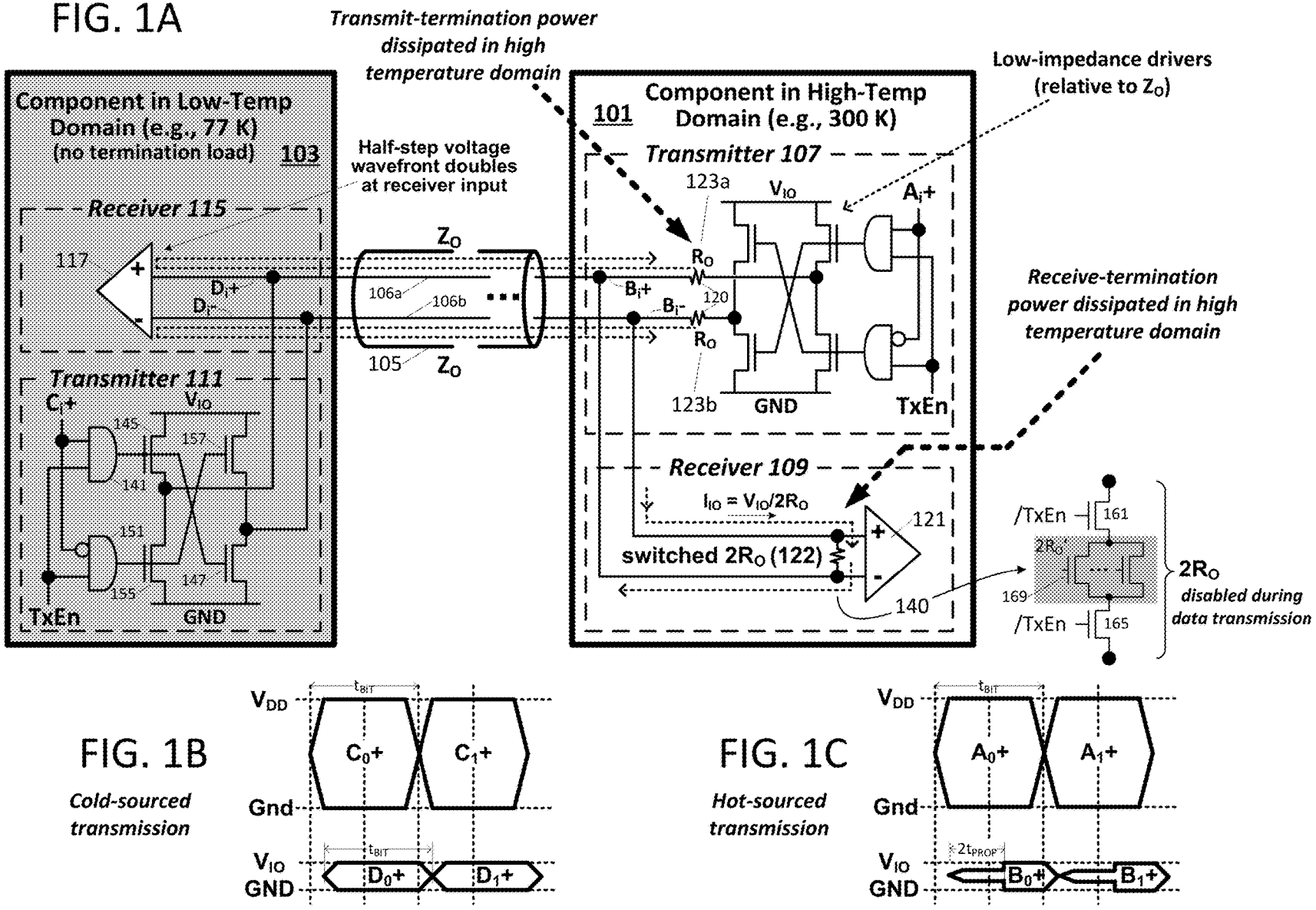
FIGS. 1A-1C illustrate an embodiment of an asymmetrically terminated signaling system and signaling waveforms therein.

FIGS. 1A-1C illustrate an embodiment of an asymmetrically terminated signaling system in which integrated circuit components 101 and 103 within respective ambient and cryogenic temperature domains are coupled to one another through a bidirectional differential signaling link 105 in which constituent "true" and "complement" conductors (106*a*, 106*b*) may be modeled as respective transmission lines having characteristic impedances, $Z_o$. In the particular example shown, the cryogenic domain and thus the cryogenic IC component 103 (also referred to herein as the "cold-side" component, chip or die) are nominally maintained at 77 K (77 Kelvin) while the ambient temperature domain and IC component 101 (referred to herein as the "hot-side" component/chip/die, with "hot" and "cold" being relative terms) are nominally 300 K, thus establishing a 223 K temperature differential between the two domains. Note that these temperatures, which are carried forward in embodiments below, and the "cryogenic" and "ambient" designations are merely examples. In all cases, other temperatures and/or temperature differentials may apply. Similarly, while a bidirectional differential point-to-point signaling embodiment is shown in the embodiment of FIG. 1A and embodiments described below, corresponding asymmetrically-terminated single-ended signaling arrangements (i.e., single conductor per information-bearing signal), unidirectional, and/or multi-drop signaling arrangements (i.e., each signaling link coupled to more than two IC components) may alternatively or additionally be deployed in all instances.

Referring in particular to FIG. 1A, each of the counterpart signaling components 101, 103 includes a transceiver circuit coupled to respective ends of the differential signaling link 105, with hot-side component 101 including a transmitter (or output driver) 107 and receiver 109 coupled in parallel with one another to the component lines 106*a*, 106*b* of the differential link 105, and cold-side component 103 including a counterpart receiver 115 and transmitter 111 coupled in parallel with one another to the component differential conductors 106*a*, 106*b* at the opposite end of the link. In the differential embodiment shown, signals transmitted by cold-side transmitter 111 are terminated within hot-side receiver 109 by a switched $2R_O$ termination load 122 (or termination resistance or termination impedance) disposed in proximity to receiver circuit 121 (e.g., a high-impedance-input differential amplifier that converts the incoming small-swing signal to higher-swing logic-level output signals) and coupled between component lines 106*a*, 106*b* of an on-chip portion of the differential signal path. The hot-side receiver termination is referred to herein as a "parallel" termination in view of its coupling in parallel with the differential inputs of receiver circuit 121 and in parallel with counterpart differential outputs of cold-side transmitter 111.

In a peer-to-peer signaling embodiment in which either of the hot-side or cold-side components may arbitrarily initiate transmission to the other, the parallel hot-side termination 122 is switchably coupled between the differential pair conductors 106*a*, 106*b* whenever the hot-side transmitter 107 is disabled (i.e., hot-side transmit-enable signal "TxEn" is low), thus maintaining link 105 in a terminated state on the assumption that the cold-side component may initiate a transmission at any time. This switch-controlled termination 122 is shown conceptually in detail view 140 in which interconnect transistors 161 and 165 are switched to a conducting state whenever TxEn is low (or its complement/TxEn is high) to switchably couple a termination load between the true and complement lines 106*a*, 106*b* of the differential pair. When the hot-side transmitter is enabled (TxEn high), transistors 161 and 165 are switched to a nominally non-conducting state to decouple parallel termination 122 from the signaling link. In alternative embodiments, an additional control signal may be supplied to interconnect transistors 161 and 165 to enable parallel termination 122 to be decoupled from signaling link 105 independently of the state of the hot-side transmit-enable signal, thus permitting decoupling of the parallel termination (i.e., "disabling the termination") during idle periods, testing/self-testing, calibration operations, etc.

In the exemplary embodiment shown at 140, the termination load is implemented by a collection of active elements (e.g., transistors) that may be individually and selectively switched to conducting or non-conducting states to establish a desired or programmed resistance or impedance value (e.g., $2R_O$ after accounting for incremental resistance of interconnect transistors 161/165). Thus, the termination resistance effected by the parallel termination 122 may be programmed (e.g., through storage of a digital setting within a register or other configuration circuit to control which transistors 169 of termination 122 are switched on and which are switched off) in a one-time or occasional/periodic calibration, for example, to account for process variations and/or run-time temperature and voltage changes. Also, while a single parallel termination element 122 is shown two or more termination elements may be selectively coupled to the signaling link (e.g., alternate termination elements 122 programmed with different termination impedances and selected as the parallel termination to be applied during a given interval according to predetermined signaling conditions, commands received within the host IC component, internal states of the host IC component, etc.).

Still referring to FIG. 1, when cold-side transmitter 111 is enabled to drive the link (e.g., TxEn raised within transmitter 111, thus enabling data bit $C_i$+ to be differentially supplied to push-pull driver transistor pairs 145/147 and 155/157 via logic gates 141 and 151, respectively), transmitter 111 will alternately couple the constituent conductors 106*a*, 106*b* of the differential link to high and low supply voltage levels ($V_{IO}$ and ground in this example), thus establishing a nominal differential voltage $V_{IO}$ on the link. For example, if $C_i$+ is a logic '1' (while TxEn is asserted), the resulting logic '1' output of AND gate 141 will switch pull-up transistor 145 and pull-down transistor 147 to a conducting state, while the logic '0' output of AND gate 151 (i.e., resulting from the inverting input or receipt of a complementary input signal, $C_i$−) will switch counterpart pull-up and pull-down transistors 155 and 157 to non-conducting states. By this arrangement, the true and complement conductors (106*a*, 106*b*) of the differential signal link 105 are driven approximately to $V_{IO}$ and ground, respectively, thus producing a differential signal that propagates to the hot-side receiver circuit 121 to enable detection/reception of the logic '1' $C_i$+ bit. As shown, the signaling current during data bit transmission, $I_{IO}$, is $V_{IO}/2R_O$ as the differential signaling voltage ($V_{IO}$) develops across the $2R_O$ parallel termination 122. When the state of $C_i$+ is flipped to logic '0', transistors 145 and 147 are switched off (i.e., output of gate 141 goes low) while transistors 155 and 157 are switched on (in response to the high output of gate 151) to drive the true and complement conductors 106*a*, 106*b* to ground and $V_{IO}$, respectively, thus driving the same $V_{IO}$ potential onto signaling link 105 and at the input of hot-side receiver circuit 121, but with opposite polarity such that the same $I_{IO}$ flows through parallel termination 122, but in the opposite direction.

Still referring to FIG. 1A, the $2R_O$ parallel termination within hot-side component may be viewed conceptually as two series $R_O$ elements, each of which terminates a respective one of conductors 106*a*, 106*b* (i.e., by matching the $Z_o$ impedance of the conductor or resistive component thereof and thus absorbing the signaling energy such that little or no reflection results) of the differential pair to a steady-state midpoint voltage of the $V_{IO}$ signal amplitude. That is, even as the signal conveyed on differential link 105 transitions between positive and negative polarities to represent successive '1' and '0' or '0' and '1' bits, the "midpoint" voltage at the junction between the conceptual series-coupled pair of $R_o$ terminations will remain at $V_{IO}/2$, thus effecting a DC termination voltage for the link.

Although link transmissions in the opposite direction, from hot-side transmitter to cold-side receiver, could be terminated by a parallel termination provided within the cryogenic domain and coupled across the cold-side receiver (indeed, such arrangement would likely yield an optimal termination due to proximity to the signal reflection point), the resulting termination power, typically on the order of 1.0 milliwatts (mW) given $V_{IO}$=1.0 v and $I_{IO}$=1.0 mA, would dissipate into the cryogenic domain as heat energy—an undesirable result in view of the power required to extract that heat energy typically being many times (e.g., 4× or more) the dissipated power. This result is avoided in the asymmetrically terminated embodiment of FIG. 1A by omitting cold-side termination altogether and instead effecting termination of hot-side-transmitted signals (i.e., hot-sourced transmissions as opposed to cold-sourced transmissions) in the hot-side component itself. In the particular implementation shown, for example, termination elements 123*a* and 123*b*, each having a nominal termination resistance $R_O$, are coupled in series between true and complement output nodes of differential transmitter (which contains component logic gates and push/pull driver pairs that operate as described with respect to cold-side transmitter 111 according to bit $A_i$+) and true and complement conductors of differential link 105, respectively. Through this "source-series" termination arrangement, the signal driven on either constituent conductor (106*a* or 106*b*) of differential link 105 traverses that conductor in both directions, propagating through the matched impedances of the termination element (123*a* or 123*b*) and transmission line to reach the high-impedance input of cold-side receiver circuit 117, and then reflecting back and passing through the line impedance again and finally being absorbed upon return-trip arrival at termination element $R_o$ (by virtue of the matched transmission line and termination impedances). Because the wavefront passes through the combined transmission and termination impedances twice (once on the way to cold-side receiver circuit 117 and then again on the return trip), the input of cold-side receiver 117 may be viewed as the centerpoint between matched resistances of a voltage divider. Accordingly, a voltage-divided or half-step wavefront arrives at cold-side receiver 117 and then doubles at the receiver input as the wavefront reflects back toward hot-side transmitter 107. Thus, conceptualizing the inbound cold-side signal as a symmetric swing around a steady-state $V_{IO}/2$ midpoint voltage (i.e., as discussed in connection with the hot-side parallel termination), a differential $V_{IO}$ signal level will arrive within cold-side component 103 as a 50% attenuated ($V_{IO}/2$) wavefront centered around the steady-state midpoint voltage (e.g., midpoint voltage $\pm V_{IO}/4$), doubling to $V_{IO}$ level at the receiver (i.e., midpoint voltage $\pm V_{IO}/2$) to yield a full-swing signal as generated by hot-side transmitter 107. Because the reflected wave on each of the differential conductors 106*a*, 106*b* is terminated upon arrival back at the hot-side transmitter (i.e., within elements 123*a* and 123*b*, respectively), no termination power is dissipated in the cold-side receiver. Thus, by terminating bidirectionally transmitted signals (exclusively in an embodiment) within hot-side component 101 or otherwise within the high-temperature domain (i.e., asymmetrically), termination power is dissipated exclusively within the high temperature domain, avoiding undesired termination-related heating within the low temperature domain.

FIGS. 1B and 1C contrast waveforms at respective signaling link contacts of the cold-side and hot-side components (i.e., at cold-side component nodes $D_i$+ and $D_i$− and hot-side component nodes $B_i$+ and $B_i$−) for cold-sourced and hot-sourced transmission of respective logic bit sequences ($C_0$+, $C_1$+ and $A_0$+, $A_1$+). Referring first to the cold-sourced transmission shown in FIG. 1B, a full-scale signal (amplitude=$V_{IO}$ in this example) appears across nodes $D_i$+/$D_i$− shortly after each logic bit ($C_0$+, $C_1$+) is supplied to transmit-enabled cold-side transmitter 111 and is maintained for the duration of a bit interval ($t_{BIT}$). By contrast, the hot-side transmission shown in FIG. 1C yields a half-step output $V_{IO}/2$ across nodes $B_i$+/$B_i$− as the outgoing signal on each component line of differential link 105 is divided between the source-series termination element ($R_O$) and the transmission line impedance ($Z_O$), doubling to the full $V_{IO}$ potential upon return of the reflected wave and thus after a time $2t_{PROP}$, where $t_{PROP}$ is the one-way signal propagation time. Because the voltage doubling will occur upon wavefront arrival at/reflection from the cold-side receiver (i.e., after $t_{PROP}$), cold-side receiver circuit 117 will perceive the full-swing ($\pm V_{IO}$) signal level for the entirety of the bit-valid interval (bit time) $t_{BIT}$, so no change in sampling point is required relative to that in a symmetrically terminated system. Further, while $2t_{PROP}$ (and thus $t_{PROP}$) are shown as being less than $t_{BIT}$ in the examples of FIG. 1C, this is not required. In alternative embodiments, the chip-to-chip signal propagation time may be longer than the bit time in which case two or more back-to-back transmitted bits or symbols may propagate simultaneously on the signal link (i.e., wave-pipelined such their respective wavefronts appear at different points along the length of the signaling link conductors).

Considering the embodiment of FIG. 1A from a system perspective, by terminating the signaling link asymmetrically with source-series termination for hot-side signal transmission and destination-parallel termination for cold-side signal transmission, termination power is dissipated exclusively in the ambient-temperature domain regardless of transmission direction. Moreover, neither signal amplitude nor integrity (nor sample-time margin) is compromised as a full-swing signal is perceived by the signal receivers 109, 115 in both domains throughout the $t_{BIT}$ interval, with terminator-absorption of undesired reflections in both transmission directions. Note also that the integrated circuit components 101 and 103 are intended to be representative of virtually any type of integrated circuit component that requires or otherwise benefits from high-speed chip-to-chip signaling including, for example and without limitation, integrated circuit devices or buffer/bridge devices having high speed serial links, chips such as processors, system on chip (SOC), field programmable gate arrays (FPGA), application specific integrated circuits (ASIC), integrated-circuit memory devices of various types (e.g., dynamic random access memory (DRAM), static random access memory (SRAM), and any of the numerous types of non-volatile memory, including Flash memory, phase-change memory, magneto-resistive memory, etc.), integrated-circuits having a memory control function (e.g., dedicated memory controllers, processors, chipset components, etc.) or any other type of integrated circuit device.

Figure 2:
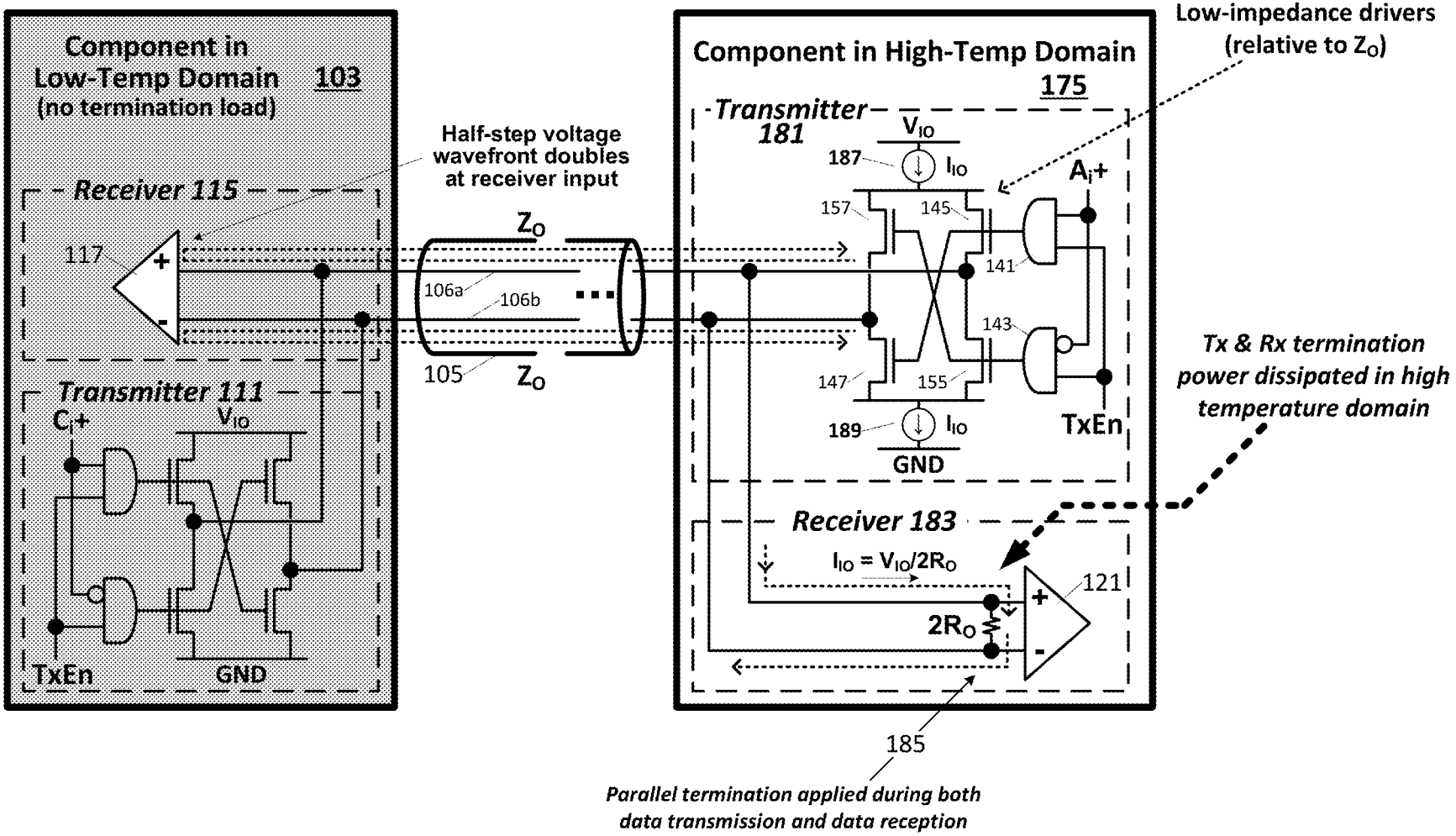
FIG. 2 illustrates an alternative embodiment of an asymmetric signaling system.

FIG. 2 illustrates an alternative embodiment of an asymmetric signaling system, in this case applying a hot-side parallel termination 185 to terminate the signaling link for both transmission directions. More specifically, cold-side transmission is carried out as before to develop $\pm V_{IO}$ across the differential input of hot-side receiver circuit 121, and absorption of reflected energy within the $2R_O$ parallel termination element 185 for both differential signal polarities. Instead of decoupling parallel termination 185 during hot-side signal transmission and terminating with source-series termination elements as in FIG. 1A, however, series termination elements are omitted and hot-side parallel termination 185 is maintained between link conductors 106*a*/106*b* to effect a source-parallel termination comparable in effect to the source-series termination shown in FIG. 1A. More specifically, the outbound transmitted wavefront is voltage-divided evenly between the characteristic impedance of a constituent differential pair conductor ($Z_O$) and the effective $R_O$ termination to steady-state voltage midpoint effected by the $2R_O$ hot-side parallel termination 185. Consequently, a half-step voltage wavefront arrives at and reflectively doubles at each input of cold-side receiver circuit 117, thus yielding a full-swing differential amplitude ($\pm V_{IO}$) at the cold-side receiver circuit as discussed in reference to FIG. 1A. The reflected wavefront is split evenly between the characteristic impedance and parallel termination 185 (effective $R_O$ termination to midpoint voltage as discussed) on the return trip and is thus fully absorbed in the matching impedances. To ensure the desired transmitter output current ($I_{IO}$) in view of the hot-side terminated output of transmitter 181, current sources 187 and 189 are provided to source and sink the outbound and inbound transmit current ($I_O$), respectively.

An additional consideration in the design of the cross-temperature signaling system shown in FIGS. 1A and 2 is the power loss resulting from thermal conduction through chip-to-chip signal conductors themselves—heat flowing through signaling conductors 106*a*/106*b* from the ambient temperature domain to the cryogenic domain. As a first order analysis, the net power loss may be viewed as a sum of resistive losses (or joule heating) within each conductor, $P_R$ and thermal losses within each conductor, $P_T$, with these power losses nominally being (for each conductor):

$$P_R=I_O^2*R_{cond}=I_O^2*\rho*L/A \quad (1),$$

where $I_O$ is the signaling current, 'ρ' is the material resistivity of the signal conductor, 'L' and 'A' are the conductor's length and cross-sectional area, respectively, '*' denotes multiplication and '/' denotes division), and $$P_T=\lambda*\Delta T*A/L \quad (2),$$

where 'λ' is material thermal conductivity, ΔT is the temperature differential between the cold and hot domains, and A and L are again the area and length of the signal conductor. Accordingly, for a given signaling current, temperature differential and conductor material, the total power loss, $P_{TOT}=P_R+P_T$, is a function of the aspect ratio of the signaling conductor (A/L). Letting 'x' denote the aspect ratio, then the total power can be expressed as a polynomial expression $P_{TOT}=K1/x+K2*x$ (where $K1=I_O^2\rho$ and $K2=\lambda*\Delta T$) having a minimum value when $x=(K1/K2)^{0.5}$—the sole inflection point of the function and the point at which $P_R=P_T$. Thus, the nominally minimum power loss, $P_{TOT,MIN}$, occurs when the aspect ratio (A/L) is $I_O*(\rho/\lambda*\Delta T)^{0.5}$, meaning that, for a given signaling current, conductor material and temperature differential, a nominally optimal conductor length can be determined upon selecting a minimum conductor area capable of conducting the signaling current (and, conversely, a nominally optimal conductor area can be determined upon selecting a minimum practicable conductor length in view of the application at hand). Further, because the minimum power loss occurs when $P_R=P_T$, the minimum power loss, $P_{TOT,MIN}$, can be expressed as $2P_T$ and thus $2*\lambda*\Delta T*A/L$, which after substituting $I_O*(\rho/\lambda*\Delta T)^{0.5}$ for the conductor aspect ratio, becomes:

$$P_{TOT,MIN}=I_O*2(\lambda*\Delta T*\rho)^{0.5} \quad (3).$$

From the foregoing expression (3) it can be seen that the minimum power loss is linearly proportional to the signaling current—an insight leveraged in power delivery embodiments discussed below. Further, from Joule's law, P=I*V, it follows that $2(\lambda*\Delta T*\rho)^{0.5}$ represents a minimum overhead voltage, $V_{OVHD}$, for a given conductor material and temperature differential. Assuming a copper conductor, for example, and the 223 K temperature differential in the embodiments above yields a minimum overhead voltage (also referred to herein as "thermal overhead") of 74 mV per conductor, or 148 mV per differential-pair signaling link (i.e., two conductors).

Observing that a thermal overhead or "wire penalty" is incurred for each conductor extending between hot and cold domains, the wire-count is reduced in a number of embodiments through multi-level signaling—conveying more than one bit of information in each transmitted symbol. Through this arrangement, the thermal overhead is effectively shared or amortized between two or more bits per symbol per link—substantially reducing the net overhead incurred relative to inter-domain signaling systems that devote a wire or wire-pair per binary symbol.

Figure 3B:
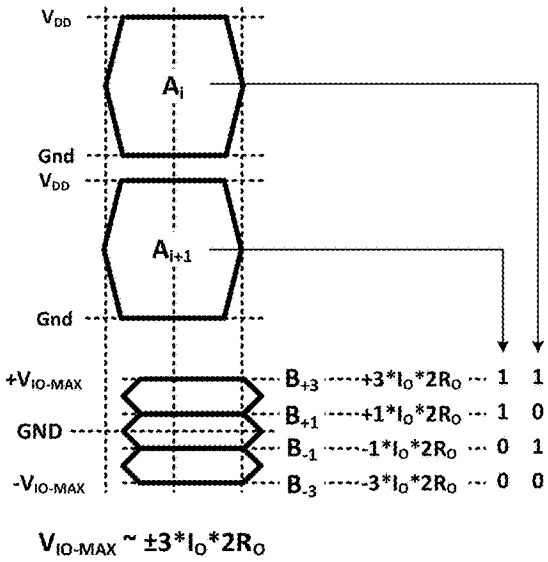
FIG. 3B illustrates a truth table and corresponding waveforms (and eye diagrams) corresponding to the cross-temperature multi-level signaling system of FIG. 3A.
Figure 3A:
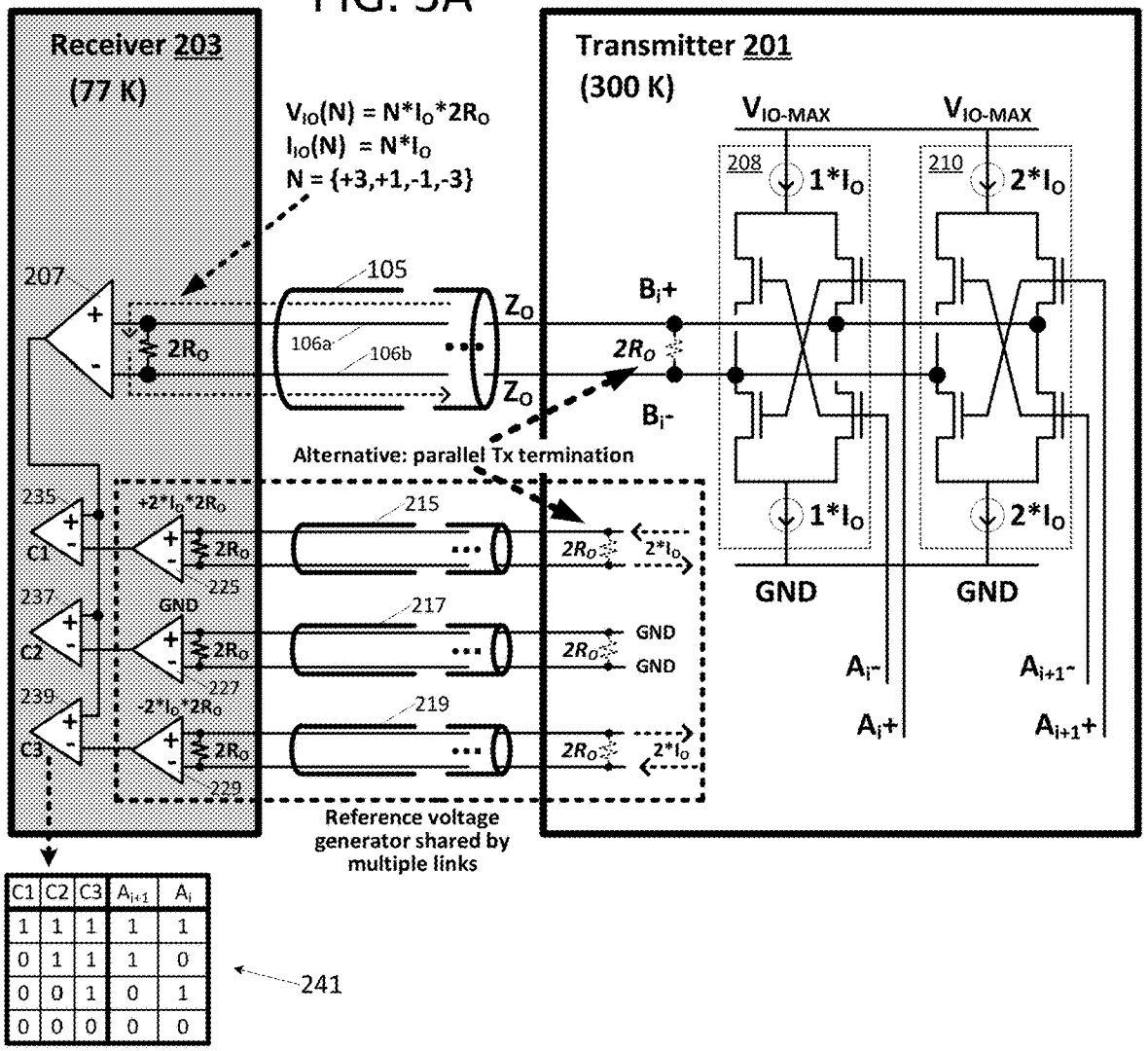
FIG. 3A illustrates an embodiment of a cross-temperature multi-level signaling system that reduces thermal overhead by encoding two bits of information within each transmitted symbol.

FIG. 3A illustrates an embodiment of a cross-temperature multi-level signaling system that reduces thermal overhead by encoding two bits of information within each transmitted symbol. For simplicity, only hot-to-cold multi-level transmission is shown, though a corresponding cold-to-hot multi-level transmission may be implemented. Also, cold-side signal link termination is shown merely for purposes of demonstrating the multiple signal levels developed at and distinguished by cold-side receiver 203. The multi-level signaling approach may be used in combination with any of the asymmetric termination embodiments discussed above, with parallel hot-side termination being shown in dashed outline as one possible option.

Still referring to FIG. 3A, hot-side transmitter 201 includes two current-source-driven push-pull output drivers 208 and 210, each implemented generally as discussed in reference to transmitter 181 of FIG. 2, but in which one output driver (210) drives the link with twice the current of the other output driver (208). By this arrangement, separate transmit data bits (i.e., $A_i$ and $A_{i+1}$, which may represent commands, data or any other information) supplied in complementary form to the inputs of respective drivers 208 and 210 will yield one of four output current levels and thus a symbol having one of four voltage levels at the differential inputs of the cold-side receiver circuit 207. More specifically, as shown by the truth table and eye-diagram in FIG. 3B, each of the four combinations of transmit data bits $A_i$ and $A_{i+1}$ yields a corresponding output current ($I_O+2I_O=+3I_O$; $-I_O+2I_O=+1I_O$; $I_O-2I_O=-1I_O$; or $-I_O-2I_O=-3I_O$) and thus a correspondingly different voltage level across the cold-side receiver circuit 207. In an embodiment terminated at the cold-side receiver, the output voltages at nodes $B_i+$ and $B_i-$(at the external contacts of the hot-side IC component) will nominally match the voltages developed across the cold-side receiver inputs, while in a hot-side source-series or parallel terminated embodiment, the waveforms at nodes $B_i+/B_i-$ will be as shown in FIG. 1C (i.e., initially a half-step voltage in view of the current split between the hot-side termination and the signaling link impedance, but doubling to full-swing voltage upon return of the reflected wavefront). In either case, the maximum differential output voltage will be $\pm3I_O*2R_O$ and the full-swing signal will be generated at cold-side receiver circuit 207 for the duration of the bit interval ($t_{BIT}$). More specifically, the voltage developed across the cold-side receiver will be a function of the N=four different output current levels, with $V_{IO}(N)=N*I_O*2R_O$, and $I_O(N)=N*I_O$, where N is any member of the set {+3, +1, −1, −3} according to the four possible combinations of the two conveyed bits. More bits may be encoded per symbol in alternative embodiments and different driver/encoding techniques may be used.

In the embodiment of FIG. 3A, additional differential conductor pairs 215, 217 and 219 are provided to generate ground and $\pm2I_O*2R_O$ reference voltage levels within receiver 203 and thus three reference voltages that enable the $N*I_O*2R_O$ received voltage level to be resolved into one of four two-bit values according to the outputs of comparators 235, 237 and 239 as shown by the truth table at 241. As with conduction of the information-bearing signal itself, the reference signal transmissions may be terminated with parallel or series termination elements within the hot-side component and, though not specifically shown, may be generated only during signal transmission (i.e., only when needed and thus disabled to save power when not needed to resolve multi-level signals). Further, the reference voltages generated at reference signal receivers 225, 227, 229 may be compared with outputs of respective receiver circuits 207 for multiple information-bearing signaling links (e.g., outputs of 4, 8, 16, 32 or more receivers 207 in a multi-link signaling system), thus amortizing the thermal overhead of the reference voltage links (215, 217, 219) across the multiple information-bearing links (105) in a manner that yields a net power saving over binary signal transmission (i.e., bit per transmitted symbol). Alternatively, reference voltages may be self-generated by the cold-side component itself (e.g., subject to one-time or periodic calibration based on incoming signal levels) thus obviating the reference signal links altogether.

FIG. 4 contrasts exemplary non-scaled and scaled power delivery modes that may be enabled within a power supply 251 for the various cross-temperature signaling system embodiments described above or more generally in any cross-temperature electronic system, regardless of termination arrangement. The scaled power delivery mode relates to the minimum thermal overhead analysis above and the insight that net thermal leakage (sum of resistive power loss and thermally-conducted power loss) associated with a current-carrying conductor is proportional to the current flowing through that conductor (per equation (3) above). Thus, when delivering power to a low temperature domain that does not support voltage/current scaling, a thermal leakage will result in accordance with the material type and current. Assuming that a cold-side memory component 253 requires a 1-volt, 1-amp DC supply (i.e., 1 Watt), then the area of the conductor (A) may be resolved to the smallest possible area ($A_O$) capable of carrying that current, and the optimal conductor length ($L_O$) may be determined according to the optimal aspect ratio discussed above (i.e., $A/L=I_O*(\rho/\lambda*\Delta T)^{0.5}$, so that $L_O=A_O*I_O*(\rho/\lambda*\Delta T)^{0.5}$). For purposes of example, the minimum area of a copper conductor capable of safely conducting one ampere is assumed to be approximately $5.0*10^{-9}M^2$, yielding a conductor length of 1.2 cm. The minimal thermal power leakage for a copper conductor extending across the exemplary 223 K temperature differential shown is (from equation 3 above) 150 mW which, at 1-amp, corresponds to a voltage overhead 'F' of 150 mV. Thus, in non-scaled mode (programmed within mode register 252), power supply 251 delivers a $V_O$=1.0 volt supply voltage and $I_O$=1.0 amp supply current to one or more components in the cryogenic domain (memory component 253 being merely an example of such component(s)) by generating a terminal voltage of $(1+F)*V_O$=1.150 volts and outputting a 1.0 amp current via supply voltage conductors 255 (i.e., output current via supply line 256A and return current via ground line 256B).

If the cold-side system supports scaled power input, power supply 251 may be transitioned to a scaled power delivery mode (e.g., by programming a different setting within mode register 252) in which the power supply terminal voltage and current are multiplied and divided, respectively, by a scaling factor S. Because thermal leakage power is proportional to supply current (i.e., the current conducted from the high temperature domain to the low temperature domain), the reduced (scaled) supply current yields a correspondingly reduced thermal power leakage. In the particular example shown, a scale factor of S=10 is used so that the power supply output current, $I_O$, drops by a factor of 10 to 0.1 amp and thermal leakage power correspondingly drops by a factor of 10 from 150 mW to 15 mW. The terminal voltage of the power supply is raised by the same scaling factor S to nominally 10 v (and somewhat more to account for downstream conversion/restoration losses as discussed below), thus yielding the same net power output as in the non-scaled power deliver: mode. Because the current carrying requirement of the power supply conductors 255 is reduced by a factor of 10, a correspondingly lower aspect ratio becomes possible (i.e., 10× smaller wire cross-sectional area for the same length, 10× longer wire for the same area or any area reduction factor M, and length increase factor N, where the product M*N is substantially equal to the scaling factor). In the example shown, minimum wire area is reduced by the scaling factor to $5.0*10^{-10}$ $M^2$ as compared to the $5.0*10^{-9}M^2$ wire area in non-scaled mode.

Still referring to FIG. 4, a DC-to-DC converter circuit 260 is provided within the cold domain to recover the desired supply voltage and current from the inbound scaled voltage and current, thus delivering $V_O/S$ and $I_O*S$ (i.e., 10 v/10=1.0 V and 0.1 A*10=1.0 A) to the cold-domain component(s) as shown. As in the non-scaled embodiment, the power supply terminal voltage is raised to account for thermal overhead voltage (150 mV in this example, and thus a factor, F=0.015 in view of the ten-times higher nominal power supply output voltage), and the power supply terminal voltage is further raised by a factor E to account for imperfect efficiency (i.e., inefficiency or efficiency factor less than 100%) in DC-to-DC converter 260. In the particular example shown, DC-to-DC converter 260 is approximately 90% efficient (requiring 1100 mW to deliver 1000 mW of power to the cold-side component(s) so that roughly 100 mW is dissipated as heat energy. Expressed as a power-supply output multiplier (E) given by $E=P_E/V_O*I_O$, where $P_E$ is the converter power loss, then under the example above E is 0.10 (10% converter loss) and the power supply terminal voltage becomes $(1+F+E)*V_O$, or approximately 11.15 volts.

Comparing the net power loss in the scaled and unsealed examples shown in FIG. 4, it can be seen that, after accounting for DC-to-DC converter inefficiency (which may be reduced in higher-efficiency converter embodiments), a net power dissipation in the power delivery path is 115 mW—a 23.3% reduction of the 150 mW thermal leakage power in the unscaled mode/system. All of the specific wire geometries, voltages, currents, material types, efficiency and fixed overhead values and scale factor(s) shown in FIG. 4, are provided for example only—different values may apply. With regard to scale factor, in particular, it is generally expected that substantial scaling (e.g., scale factor greater than at least 2, 4, 5, 8, 10, or higher) will be beneficial, though any greater-than-one value may be applied.

Figure 5:
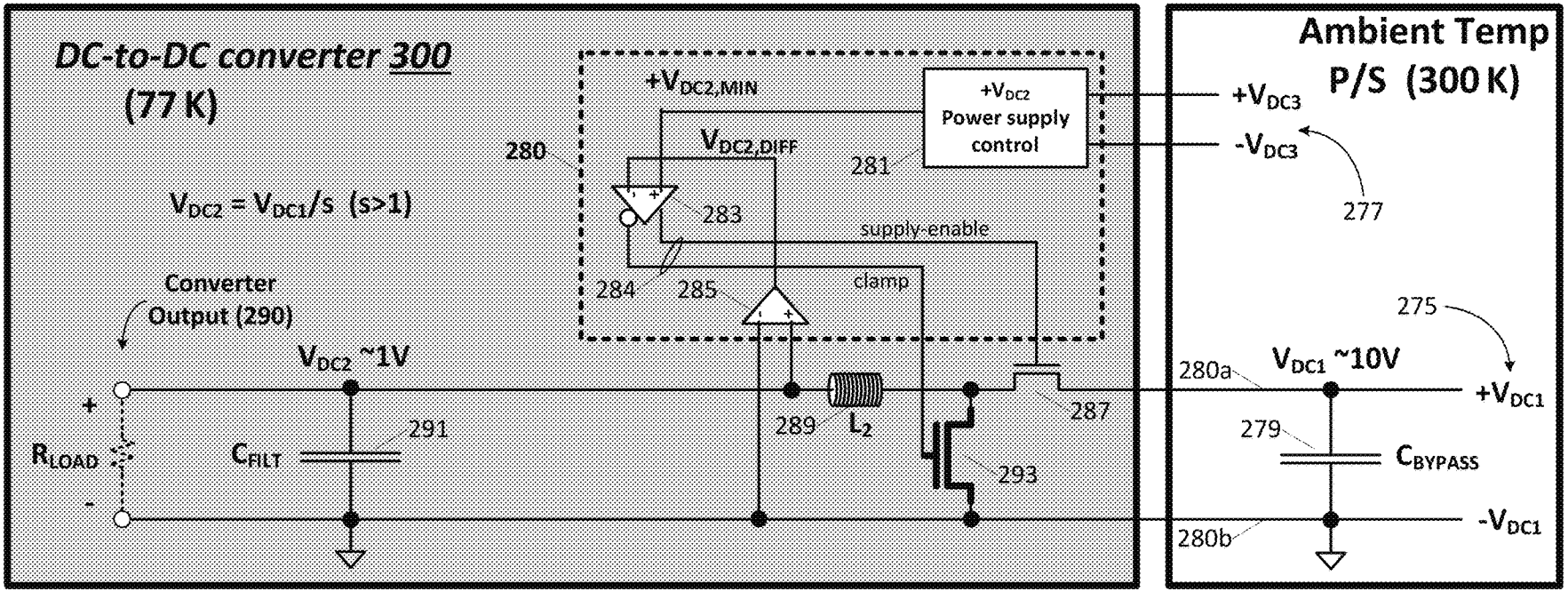
FIG. 5 illustrates an embodiment of a DC-to-DC converter that may be used to implement the DC-to-DC converter shown in the scalable power delivery system of FIG. 4.

FIG. 5 illustrates an embodiment of a DC-to-DC converter 300 that may be used to implement the DC-to-DC converter 260 shown in the scalable power delivery system of FIG. 4. In the high-temperature domain (shown to be 300 K in this example), a power supply terminal voltage of $V_{DC1}$=10 v is generated on power supply output and return lines (280*a* and 280*b*, respectively) extending between the high temperature and low temperature domains as shown at 275 (the return line 280*b* is grounded in this example, though that need not be the case). A differential reference voltage $V_{DC3}$, shown at 277 and corresponding to a desired load voltage $V_{DC2}$ (i.e., load voltage to be generated at the DC-to-DC converter output 290 and thus supplied to one or more components in the low temperature domain), is also conducted between the two temperature domains and supplied, within the cold domain, to power supply control circuit 281. In the embodiment shown, control circuit 281 generates, based on the incoming differential reference voltage, a single-ended local reference voltage "$+V_{DC2,\ MIN}$," providing the local reference voltage to comparator 283.

Still referring to FIG. 5, comparator 283 also receives a measure of the DC-to-DC converter output voltage (i.e., measure of voltage at 290) from unity-gain buffer/amplifier 285 (i.e., $V_{DC2,DIFF}$) and generates a differential pair of control signals 284 according to whether the local reference voltage exceeds the converter output voltage or vice-versa. More specifically, if the local reference voltage exceeds the converter output voltage, the comparator asserts a "supply-enable signal" to switch on supply transistor 287 and thus enable the hot-side DC supply (i.e., $V_{DC1}$ generator 275) to source current to the load ($R_{LOAD}$) coupled across converter output 290 and also to filter capacitor 291 ($C_{FILT}$), thereby raising the filter capacitor voltage and the voltage across the load (with filter capacitor 291 serving to ensure a gradual increase in converter output voltage 290). Inductor $L_2$ 289 is provided to smooth the load current profile and thus energizes (charges) while supply transistor 287 is switched on.

Converter output voltage 290 continues to rise (filter capacitor continues to charge) while the supply-enable signal is asserted, eventually rising to a point such that $V_{DC2,DIFF}$ exceeds the local reference voltage, $V_{DC2,MIN}$. At that point, the output state of comparator 283 reverses, deasserting the supply-enable signal and asserting a complementary "clamp" signal so that supply transistor 287 is switched off (i.e., to a nominally non-conducting state) and clamp transistor 293 is switched on to clamp the back-EMF generated within inductor 289 at the converter output voltage (i.e., back-EMF generated in response to the sudden cessation of supply current previously flowing via transistor 287). During this "supply-disable" interval, the voltage on filter capacitor 291 decays (i.e., as the current through inductor 289 drops and filter capacitor 291 sources current to the load) until converter output voltage 290 once again falls below the local reference voltage whereupon the output of comparator 283 reverses again to re-enable the supply current flow via supply transistor 287. Thus, the buffered measurement of the converter output voltage is supplied in a negative feedback loop (formed at least in part by the buffer 285, comparator 283 and supply/clamp transistors 287/293) to switchably enable supply current from the higher-voltage hot-side supply as necessary to maintain a reference-controlled converter output voltage. In general, the switching frequency (i.e., rate at which DC-to-DC converter 300 cycles between successive supply-enable states) is limited by the bandwidth of the feedback loop, which is itself a function of the inductor and filter capacitor sizes as well as the bandwidth of the buffer and comparator components. In one embodiment, clamp transistor 293 is implemented by a MOS (metal oxide semiconductor) power device to withstand the considerable back-EMF-induced current spike generated when the supply transistor is shut off. Also, a bypass capacitor 279 may be provided in the hot-side domain to filter voltage disturbances generated on the inter-domain conductors 280*a*/280*b* as DC-to-DC converter 300 switches between supply-enable and supply-disable states. Various changes may be made to DC-to-DC converter 300 in alternative embodiments and altogether different implementations may be used to implement the DC-to-DC converter 260 deployed within the system of FIG. 4 (i.e., virtually any circuitry capable of effecting conversion between two DC voltage levels with a desired efficiency). For example, while the inter-domain current flow on the $V_{DC3}$ conductors is extremely low relative to the power supply current (i.e., such that any incremental thermal/resistive power loss due to those conductors is negligible and the $V_{DC3}$ conductors may be implemented with a very small aspect ratio (A/L)), the reference voltage may be generated within the cold domain itself in alternative embodiments to obviate the inter-domain $V_{DC3}$ conductors altogether. In such an embodiment, one-time or periodic calibration may be carried out to maintain the reference voltage within a predetermined/programmed range or at a predetermined/programmed setpoint.

It should be noted that the various circuits disclosed herein may be described using computer aided design tools and expressed (or represented), as data and/or instructions embodied in various computer-readable media, in terms of their behavioral, register transfer, logic component, transistor, layout geometries, and/or other characteristics. Formats of files and other objects in which such circuit expressions may be implemented include, but are not limited to, formats supporting behavioral languages such as C, Verilog, and VHDL, formats supporting register level description languages like RTL, and formats supporting geometry description languages such as GDSII, GDSIII, GDSIV, CIF, MEBES and any other suitable formats and languages. Computer-readable media in which such formatted data and/or instructions may be embodied include, but are not limited to, computer storage media in various forms (e.g., optical, magnetic or semiconductor storage media, whether independently distributed in that manner, or stored "in situ" in an operating system).

When received within a computer system via one or more computer-readable media, such data and/or instruction-based expressions of the above described circuits may be processed by a processing entity (e.g., one or more processors) within the computer system in conjunction with execution of one or more other computer programs including, without limitation, net-list generation programs, place and route programs and the like, to generate a representation or image of a physical manifestation of such circuits. Such representation or image may thereafter be used in device fabrication, for example, by enabling generation of one or more masks that are used to form various components of the circuits in a device fabrication process.

In the foregoing description and in the accompanying drawings, specific terminology and drawing symbols have been set forth to provide a thorough understanding of the present invention. In some instances, the terminology and symbols may imply specific details that are not required to practice the invention. For example, any of the specific numbers of bits, signal path widths, signaling or operating frequencies, component circuits or devices and the like may be different from those described above in alternative embodiments. Additionally, links or other interconnection between integrated circuit devices or internal circuit elements or blocks may be shown as buses or as single signal lines. Each of the buses may alternatively be a single signal line, and each of the single signal lines may alternatively be buses. Signals and signaling links, however shown or described, may be single-ended or differential. A signal driving circuit is said to "output" a signal to a signal receiving circuit when the signal driving circuit asserts (or deasserts, if explicitly stated or indicated by context) the signal on a signal line coupled between the signal driving and signal receiving circuits. The term "coupled" is used herein to express a direct connection as well as a connection through one or more intervening circuits or structures. Integrated circuit device "programming" may include, for example and without limitation, loading a control value into a register or other storage circuit within the integrated circuit device in response to a host instruction (and thus controlling an operational aspect of the device and/or establishing a device configuration) or through a one-time programming operation (e.g., blowing fuses within a configuration circuit during device production), and/or connecting one or more selected pins or other contact structures of the device to reference voltage lines (also referred to as strapping) to establish a particular device configuration or operation aspect of the device. The terms "exemplary" and "embodiment" are used to express an example, not a preference or requirement.

While the invention has been described with reference to specific embodiments thereof, it will be evident that various modifications and changes may be made thereto without departing from the broader spirit and scope. For example, features or aspects of any of the embodiments may be applied in combination with any other of the embodiments or in place of counterpart features or aspects thereof. Accordingly, the specification and drawings are to be regarded in an illustrative rather than a restrictive sense.

What is claimed is:

1. A voltage converter comprising:

a first input to receive a supply voltage from a power supply component;

a second input to receive a reference voltage from the power supply component, the supply voltage being higher than the reference voltage by a scaling factor of at least five;

a filter capacitor; and control circuitry to iteratively charge the filter capacitor to produce a converted voltage that follows the reference voltage by switchably coupling the first input to the filter capacitor while the converted voltage is less than the reference voltage to raise the converted voltage, and switchably decoupling the first input from the filter capacitor while the converted voltage exceeds the reference voltage to enable the converted voltage to decay.

2. The voltage converter of claim 1 wherein the control circuitry to iteratively charge the filter capacitor comprises:

a comparator to compare the converted and reference voltages and output a first control signal having either a first logic state or a second logic state according to whether the converted voltage is less or greater than the reference voltage; and switch circuitry to couple the first input to the filter capacitor when the first control signal has the first logic state and decouple the first input from the filter capacitor when the control signal has the second logic state.

3. The voltage converter of claim 2 wherein the switch circuitry comprises a first metal oxide semiconductor (MOS) transistor coupled between the first input and a first terminal of the filter capacitor, the first MOS transistor having a gate terminal coupled to receive the first control signal.

4. The voltage converter of claim 3 further comprising:

an inductive element coupled in series between the first terminal of the filter capacitor and a source terminal of the first MOS transistor; and a second MOS transistor to switchably couple the source terminal of the first MOS transistor to a second terminal of the filter capacitor while the first control signal has the second logic state.

5. The voltage converter of claim 4 wherein the comparator additionally outputs, to a gate terminal of the second MOS transistor, a second control signal that is a complement of the first control signal such that the first MOS transistor is switched to a conducting state when the second MOS transistor is switched to a non-conducting state and vice-versa.

6. The voltage converter of claim 4 wherein a voltage across the first and second terminals of the filter capacitor constitutes the converted voltage.

7. The voltage converter of claim 2 wherein the second input to receive the reference voltage from the power supply component comprises a differential input to receive a differential reference voltage, the voltage converter further comprising circuitry to generate a single-ended reference voltage having an amplitude, relative to a ground potential, that corresponds to an amplitude of the differential reference voltage, and to supply the single-ended reference voltage to a first input of the comparator.

8. The voltage converter of claim 6 further comprising circuitry to generate a buffered voltage that corresponds the converted voltage and to supply the buffered voltage to a second input of the comparator.

9. The voltage converter of claim 1 wherein the control circuitry to iteratively charge the filter capacitor by switchably coupling the first input to the filter capacitor comprises circuitry to switchably couple the first input to a first terminal of the filter capacitor, and wherein a voltage across the first terminal of the filter capacitor and a second grounded terminal of the filter capacitor constitutes the converted voltage.

10. A method of operation within voltage conversion circuit, the method comprising:

receiving, at a first input, a supply voltage from a power supply component;

receiving, at a second input, a reference voltage from the power supply component, the supply voltage being higher than the reference voltage by a scaling factor of at least five; and iteratively charging a filter capacitor to produce a converted voltage that follows the reference voltage, including switchably coupling the first input to the filter capacitor while the converted voltage is less than the reference voltage to raise the converted voltage, and switchably decoupling the first input from the filter capacitor while the converted voltage exceeds the reference voltage to enable the converted voltage to decay.

11. The method of claim 10 wherein iteratively charging the filter capacitor comprises:

comparing the converted voltage and the reference voltage within a comparator to generate a first control signal having either a first logic state or a second logic state according to whether the converted voltage is less or greater than the reference voltage; and switchably coupling the first input to the filter capacitor when the first control signal has the first logic state; and switchably decoupling the first input from the filter capacitor when the control signal has the second logic state.

12. The method of claim 11 wherein switchably coupling the first input to the filter capacitor when the first control signal has the first logic state and switchably decoupling the first input from the filter capacitor when the first control signal has the second logic state comprises applying the first control signal to a gate terminal of a first metal oxide semiconductor (MOS) transistor coupled between the first input and a first terminal of the filter capacitor.

13. The method of claim 12 wherein an inductive element is coupled in series between the first terminal of the filter capacitor and a source terminal of the first MOS transistor, the method further comprising switchably coupling the source terminal of the first MOS transistor to a second terminal of the filter capacitor via a second MOS transistor while the first control signal has the second logic state.

14. The method of claim 13 wherein switchably coupling the source terminal of the first MOS transistor to a second terminal of the filter capacitor via a second MOS transistor while the first control signal has the second logic state comprises generating a second control signal that is a complement of the first control signal and applying the second control signal to a gate terminal of the second MOS transistor such that the first MOS transistor is switched to a conducting state when the second MOS transistor is switched to a non-conducting state and vice-versa.

15. The method of claim 13 wherein a voltage across the first and second terminals of the filter capacitor constitutes the converted voltage.

16. The method of claim 11 wherein receiving the reference voltage from the power supply component at the second input comprises receiving a differential reference voltage, and wherein comparing the converted voltage and the reference voltage within the comparator comprises generating a single-ended reference voltage having an amplitude, relative to a ground potential, that corresponds to an amplitude of the differential reference voltage, and supplying the single-ended reference voltage to a first input of the comparator.

17. The method of claim 16 wherein comparing the converted voltage and the reference voltage within the comparator comprises generating a buffered voltage that corresponds to the converted voltage and supplying the buffered voltage to a second input of the comparator.

18. The method of claim 10 wherein the scaling factor is ten or higher.

19. The method of claim 10 wherein switchably coupling the first input to the filter capacitor comprises switchably coupling the first input to a first terminal of the filter capacitor, and wherein a voltage across the first terminal of the filter capacitor and a second grounded terminal of the filter capacitor constitutes the converted voltage.

20. A voltage converter comprising:

a first input to receive a supply voltage from a power supply component;

a second input to receive a reference voltage from the power supply component, the supply voltage being higher than the reference voltage by a scaling factor of at least five;

a filter capacitor; and means for iteratively charging a filter capacitor to produce a converted voltage that follows the reference voltage, including (i) means for switchably coupling the first input to the filter capacitor while the converted voltage is less than the reference voltage to raise the converted voltage, and (ii) means for switchably decoupling the first input from the filter capacitor while the converted voltage exceeds the reference voltage to enable the converted voltage to decay.

* * * * *